US008939352B2

(12) United States Patent
Delause et al.

(10) Patent No.: US 8,939,352 B2
(45) Date of Patent: Jan. 27, 2015

(54) TRAY, ASSEMBLY OF CARDBOARD BLANKS, AND DEVICE AND METHOD FOR FORMING SUCH A TRAY

(75) Inventors: Bernard Delause, Epinal (FR); Gerard Mathieu, Cergy (FR); Didier Desertot, Arc sur Tille (FR)

(73) Assignee: Otor, Puteaux (FR)

( * ) Notice: Subject to any disclaimer, the term of this patent is extended or adjusted under 35 U.S.C. 154(b) by 487 days.

(21) Appl. No.: 13/257,319

(22) PCT Filed: Mar. 22, 2010

(86) PCT No.: PCT/FR2010/000241

§ 371 (c)(1),
(2), (4) Date: Nov. 11, 2011

(87) PCT Pub. No.: WO2010/106255

PCT Pub. Date: Sep. 23, 2010

(65) Prior Publication Data

US 2012/0111933 A1 May 10, 2012

(30) Foreign Application Priority Data

Mar. 20, 2009 (FR) ..... 09 01304

(51) Int. Cl.

| | |
|---|---|
| ***B65D 5/28*** | (2006.01) |
| ***B65D 5/32*** | (2006.01) |
| ***B31B 1/14*** | (2006.01) |

(Continued)

(52) U.S. Cl.

CPC . *B65D 5/323* (2013.01); *B31B 1/14* (2013.01); *B31B 1/44* (2013.01); *B65D 5/001* (2013.01); *B31B 2201/0282* (2013.01); *B31B 2201/14* (2013.01); *B31B 2201/2654* (2013.01); *B31B 2217/00* (2013.01); *B31B 2217/086* (2013.01)

USPC ..... 229/122.26; 229/122.24

(58) Field of Classification Search

USPC ..... 229/164, 172, 174–176, 178, 195, 165, 229/169, 122.21–122.27; 493/122–126, 62; 53/558

See application file for complete search history.

(56) References Cited

U.S. PATENT DOCUMENTS 2,021,254 A * 11/1935 Claff ..... 493/62
RE23,257 E * 8/1950 Hunsworth ..... 229/120.37

(Continued)

FOREIGN PATENT DOCUMENTS

DE 3134666 A1 3/1983
FR 2196636 A 3/1974

(Continued)

OTHER PUBLICATIONS

International Search Report for PCT/FR2010/000241 dated May 19, 2010.

*Primary Examiner* — Justin Larson
*Assistant Examiner* — Phillip Schmidt
(74) *Attorney, Agent, or Firm* — Banner & Witcoff, Ltd.

(57) ABSTRACT

The invention relates to a cardboard tray made of three parts, to an assembly of blanks, and to a device and method for producing such a tray. The tray comprises a first part defining a bottom connected by first fold lines to two first opposite sidewalls and two second parts defining second opposite sidewalls, each comprising at least one longitudinal first flap connected to said second wall by a second fold line and glued on the bottom, and two sets of transverse flaps, each comprising at least one transverse flap glued to a first corresponding opposite side wall, respectively.

31 Claims, 20 Drawing Sheets

(51) Int. Cl.
*B31B 1/44* (2006.01)
*B65D 5/00* (2006.01)

(56) References Cited

U.S. PATENT DOCUMENTS 2,784,900 A * 3/1957 Bauer ..... 229/125.19
2,794,588 A * 6/1957 George et al. ..... 229/125.16
3,863,831 A * 2/1975 Wozniacki et al. ..... 229/120
4,461,137 A 7/1984 Wood
5,549,242 A 8/1996 Gimeno
7,635,080 B2 * 12/2009 Conway ..... 229/169
8,323,165 B2 * 12/2012 Atoui ..... 493/175
2003/0168502 A1 * 9/2003 Kisch ..... 229/120.34
2004/0056081 A1 * 3/2004 Christensen et al. .... 229/122.26
2007/0102497 A1 * 5/2007 Borek et al. ..... 229/122.24
2008/0032878 A1 * 2/2008 Kisch ..... 493/174
2008/0081754 A1 * 4/2008 Plemons et al. ..... 493/84

FOREIGN PATENT DOCUMENTS

FR 2885881 A 11/2006
JP 10194285 A 7/1998

* cited by examiner

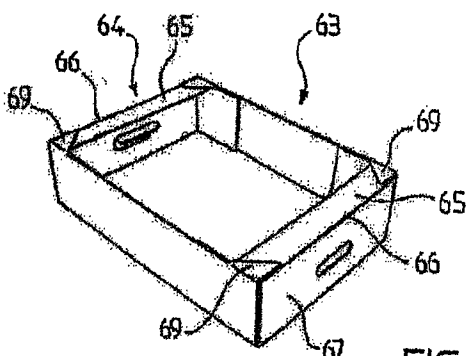
FIG.10A
FIG.10B
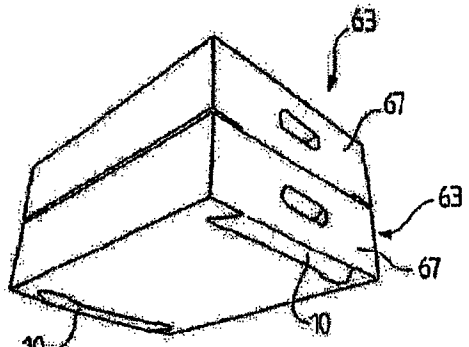
FIG.10C
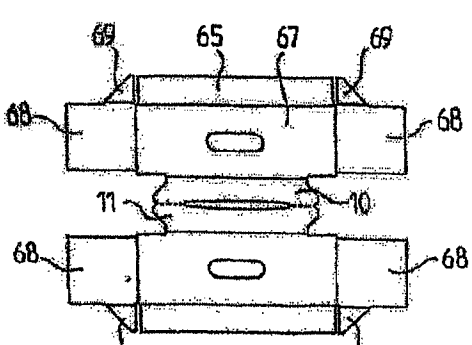
FIG.11

TRAY, ASSEMBLY OF CARDBOARD BLANKS, AND DEVICE AND METHOD FOR FORMING SUCH A TRAY

The present invention relates to a tray made of cardboard sheet material formed of three separate parts.

It also relates to a set of blanks to form such a tray, a device for forming such a tray and a corresponding method.

It finds a particularly important, although not exclusive, application in the field of stackable corrugated cardboard trays that are sufficiently strong to contain products of various shapes such as for example fruit or semirigid sachets of the soup sachet type, which can therefore not themselves play a role in resistance to compression of the packaging.

Single-blank corrugated cardboard trays have been known for a long time.

These trays do not naturally withstand compression as much as closed packages of the American box type.

To partially alleviate this drawback, trays have been proposed comprising corner returns or beams.

Moreover, the latter have thus made it possible to substantially reduce basis weights relative to conventional packaging.

Such single-blank packages however have drawbacks.

In particular, they are not easy to stack.

Specifically, in order to allow them to be stacked firmly and securely, the prior art of the tray provides for stacking tenons.

However, the latter are fragile and difficult to insert precisely and repetitively into the corresponding mortices.

Another drawback of the known single-blank trays is due to the horizontal corrugations of two side faces which therefore contribute only very slightly to the compression-resistance of the tray.

Moreover, although certain trays can be made fairly resistant to vertical compression by virtue notably of protruding elements and/or corner beams, the bending of the bottoms of the trays continues for its part to pose problems.

Finally, it has unfortunately been found that the slightest defect of geometry of the trays of the prior art, generally formed by pressing in a cavity, has a considerable impact on their Vertical Compression Resistance (VCR).

The object of the present invention is to alleviate these drawbacks by proposing a tray made of cardboard sheet material, a set of blanks, a device and a method for manufacturing such a tray, that provide a better answer than those previously known to the requirements of the practice, notably in that it proposes an easily stackable tray made of three elements of which two side elements form side beams, each furnished with a flap for bonding to the bottom of the third element.

Such a tray is tolerant to defects of geometry, without compromising its VCR.

Each of the three elements will be able to oriented and dimensioned, in basis weight and in thickness of corrugation, so as to optimize its function, namely either resistance to vertical compression or resistance to buckling.

Advantageously, the invention makes it possible in particular to provide vertical corrugations for each of the side walls while allowing simple, effective and durable stacking of the trays.

For this purpose, the present invention proposes notably a tray made of cardboard sheet material, characterized in that it is formed of three separate parts, namely a first part forming a bottom connected by first fold lines to two first opposite side walls and two second parts forming two second opposite side walls each comprising at least one first longitudinal flap connected to the second wall by a second fold line and bonded to the bottom and two sets of transverse flaps each comprising at least one transverse flap respectively bonded to a corresponding first side wall facing it.

In particular embodiments, use is made of one and/or the other of the following arrangements, in isolation or in combination:

- the first two opposite walls have a free top edge with no longitudinal flap. Such an arrangement is beneficial for automatic manufacture;
- the bottom comprises four squashed end surfaces respectively situated at the four corners of the tray. The localized squashing at the ends of the bottom will therefore give it an elasticity which will allow a slight bowing;
- each first longitudinal flap is bonded to the outer face of the bottom;
- each first flap is bonded to the inner face of the bottom;
- the basis weight of the cardboard of the bottom and of the two first side walls is different from that of the two second side walls;
- the corrugations of the first walls and of the second walls are perpendicular to the bottom of the tray;
- each set of transverse flaps comprises a first transverse flap connected to the corresponding second side wall by a third fold line and bonded to the inner face of the adjacent first side wall. In other words, the first two opposite walls are bonded to the outer face of the transverse flaps facing them. Thus, the side walls are straight without protuberance due to flaps overlapping;
- each set comprises a second transverse flap connected by a fourth fold line to said first transverse flap to form a corner of the tray, said second transverse flaps each being themselves connected by a fifth fold line to a third transverse flap interacting with the inner face of the facing second walls;
- a second wall comprises a longitudinal tab connected by an outer fold line to form a lid to the tray;
- each second wall also comprises at least one second longitudinal flap connected to said second wall by a sixth fold line on the side opposite to the first longitudinal flap;
- the second longitudinal flap itself comprises at least one end tongue that is folded down;
- each second wall comprises a single second longitudinal flap furnished on either side with an end tongue that is folded down and bonded to the outer face of the first flap or of the first side wall facing it, said second flap forming a transverse protruding element on two opposite ends of said tray;
- each second wall comprises two second longitudinal end flaps each furnished with one of said end tongues that is folded down, forming consolidation lugs to the four opposite ends of said tray;
- each first transverse flap also comprises at least one side tongue that is folded down and bonded to the second, one-piece, longitudinal flap forming a protruding element;
- each second flap comprises a recess at the sixth fold line;
- the side ends of the first longitudinal flaps bonded to the bottom of the tray are of a shape to match the upper surface of the tray and/or of the second longitudinal flap(s) and/or of the recesses, in order to allow one to fit into the other when two trays are stacked on one another;
- each second wall comprises a central fold in an isosceles triangle and two first longitudinal flaps situated on either side of said central fold;
- the tray comprises eight sides;

the third fold lines are at an angle relative to the perpendicular to the first fold lines so as to give a frustoconical shape to said tray;

at least one first side wall comprises fifth flaps connected on either side of the first wall by sixth fold lines capable of interacting with the outer face of an adjacent transverse flap;

the second walls are higher than the adjacent first side walls;

the tray comprises a first side wall that is pierced with holes partially or over the whole of its length or furnished with a longitudinal tear-off strip.

The invention also proposes a set of blanks to form a tray made of cardboard sheet material as described above.

Advantageously, it also proposes a set of blanks to form a tray made of cardboard sheet material, characterized in that it comprises a first blank formed of a bottom connected by first fold lines to two first opposite side walls and a second blank capable of forming two second opposite side walls of said tray that are identical and placed on either side relative to a line of separation, each second side wall each comprising at least a first longitudinal flap connected on one side to a corresponding second wall by a second fold line and on the other side by said line of separation to the outer periphery of the other first longitudinal flap of the other second symmetrical side wall facing it, said first longitudinal flaps being arranged to be bonded to the bottom and each second wall also comprising two sets of transverse flaps, said sets each comprising at least one transverse flap suitable for being respectively bonded to a corresponding first side wall facing it when the tray is formed.

In advantageous embodiments, use is also made of one and/or the other of the following arrangements:

the second opposite walls are symmetrical relative to the line of separation;

one of the opposite walls is connected by an outer fold line to an upper tab to form a lid to the tray;

the bottom comprises four squashed end surfaces respectively situated at the four corners of the tray;

each set of transverse flaps comprises a first transverse flap connected to the corresponding second side wall by a third fold line and is capable of being bonded to the inner face of the adjacent first side wall;

each set comprises a second transverse flap connected by a fourth fold line to said first transverse flap to form a corner of the tray, said second transverse flaps themselves each being connected by a fifth fold line to a third transverse flap to interact with the inner face of the second walls facing them;

each second wall also comprises at least one second longitudinal flap connected to said second wall by a sixth fold line on the side opposite to the first longitudinal flap;

each second wall comprises a central fold in an isosceles triangle and two first longitudinal flaps situated on either side of said central fold;

the third fold lines are at an angle relative to the perpendicular to the first fold lines, so as to give a frustoconical shape to said tray once formed.

The invention also proposes a device for forming a tray from two blanks of cardboard sheet material or corrugated cardboard, namely a first blank formed of a bottom connected by first fold lines to two first opposite side walls and a second blank capable of forming two second opposite side walls of said tray, that are identical and symmetrical relative to a line of separation, each second side wall each comprising at least one first longitudinal flap connected on one side to a corresponding second wall by a second fold line and on the other side by the said line of separation to the outer periphery of the other first longitudinal flap of the second symmetrical side wall facing it, and two sets of transverse flaps each comprising at least one transverse flap, characterized in that it comprises two storage magazines for storing respectively the first and second blanks, means for cutting the second blank at the line of separation to form the two second opposite side walls, means for picking up and transferring the first blank from the storage magazine to an assembly station, means for firmly positioning the first blank in abutment in order to give it an exact reference position, means for picking up and transferring laterally by suction cups the second walls in order to place them on the first blank cut-out thus indexed, means for pasting the first longitudinal flaps and the inner face of the second walls and/or of the sets of second flaps during their transfer, means for pressing the first longitudinal flaps on the first blank, means for folding the sets of flaps toward the second walls, means for transferring the set of blanks thus constituted to a forming station, and forming means at said forming station.

Advantageously, the forming means comprise a mandrill and means for winding the set of blanks around said mandrill in order to form the tray.

Equally advantageously, each set of transverse flaps comprising a first transverse flap connected to the corresponding second side wall by a third fold line and a second transverse flap connected by a fourth fold line to said first transverse flap, said second transverse flaps each being themselves connected by a fifth fold line to a third transverse flap, the means for folding said sets comprise pins for forming a corner of the tray and pushing means for pressing said third transverse flaps onto the inner face of the second walls facing them.

In one advantageous embodiment, each second wall also comprising at least one second longitudinal flap connected to said second wall by a sixth fold line on the side opposite to the first longitudinal flap, the device also comprises means for folding said second longitudinal flap to form at least two lugs or two protruding elements on either side of the tray, and the mandrill can be retracted between a position of forming the tray and a position of escapement from the lugs or protruding elements.

Equally advantageously, each second wall comprising three central fold lines parallel to the third fold lines and two first longitudinal flaps situated on either side of said central fold, the device comprises means for folding said three lines to form in the middle of said second walls a central fold in an isosceles triangle.

The invention also proposes a method for forming a tray from two blanks of cardboard sheet material or corrugated cardboard, namely a first blank formed of a bottom connected by first fold lines to two first opposite side walls and a second blank capable of forming two second opposite side walls of said tray, identical and symmetrical relative to a line of separation, each second side wall each comprising at least one first longitudinal flap connected on one side to a corresponding second wall by a second fold line and on the other side by said line of separation to the outer periphery of the other first longitudinal flap of the second symmetrical side wall facing it, and two sets of transverse flaps each comprising at least one transverse flap, characterized in that, after cutting the second blank at the line of separation to form the two second opposite side walls, the first blank is transferred to an assembly station, the first blank is firmly positioned in abutment in order to give it an exact reference position, the second walls are transferred laterally by suction cups while pasting the first longitudinal flaps and the inner face of the second walls and/or the sets of second flaps during their transfers, then they are placed on the first blank cut-out thus indexed, the first longitudinal flaps are pressed onto the first blank, the sets of flaps are folded toward the second walls, and the set of blanks thus constituted is transferred to a forming station to form the tray.

In one advantageous embodiment, the forming is carried out by winding around a mandrill.

Advantageously, each set of transverse flaps comprising a first transverse flap connected to the corresponding second side wall by a third fold line and a second transverse flap connected by a fourth fold line to said first transverse flap, said second transverse flaps each being themselves connected by a fifth fold line to a third transverse flap, said sets are folded around pins to form a corner of the tray and said third transverse flaps are pressed onto the inner face of the second walls facing them.

Equally advantageously, each second wall also comprising at least one second longitudinal flap connected to said second wall by a sixth fold line on the side opposite to the first longitudinal flap, said second longitudinal flap is folded to form at least two lugs or two protruding elements on either side of the tray, and the mandrill is retracted between a position for forming the tray and a position of escapement from the lugs or protruding elements.

In one advantageous embodiment, each second wall comprising three lines of central folds parallel to the third fold lines and two first longitudinal flaps situated on either side of said central fold, said three fold lines are folded to form, in the middle of said second walls, a central fold in an isosceles triangle.

The invention will be better understood on reading the following description of embodiments given below as non-limiting examples and with reference to the drawings which accompany it in which:

FIGS. 1, 2 and 3 are views in perspective from below, from above and from in front of two stackable trays according to a first embodiment of the invention with reinforcement corners.

FIGS. 4A, 5C and 6A, 7C give views, respectively in perspective and flattened out, of the three parts of the tray of FIG. 1.

FIGS. 10A, 10B and 10C show in views from above and from below two trays obtained with the parts for second side walls of the blank of FIG. 11, with protruding elements and corner braces.

FIGS. 23A, 23B, 24 and 25 give in flattened blank form and in perspective another embodiment of a tray with central fold according to the invention.

FIGS. 26A through 26G show in perspective and schematically the various operations carried out when applying the method according to the embodiment of the invention more particularly described here.

Figures 27A, 27B:
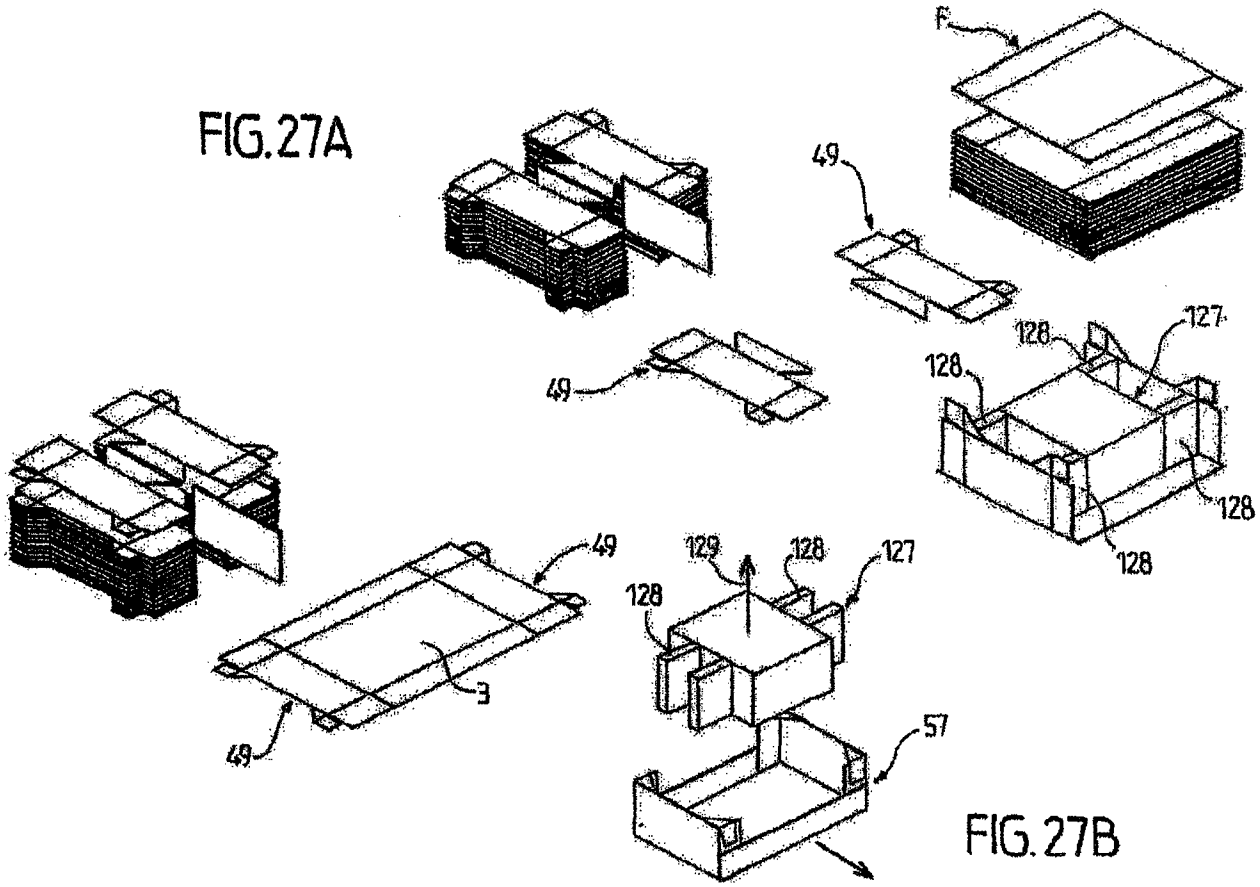

FIGS. 27A and 27B illustrate a variant execution of this method with retractable cylinder.

Figure 28:
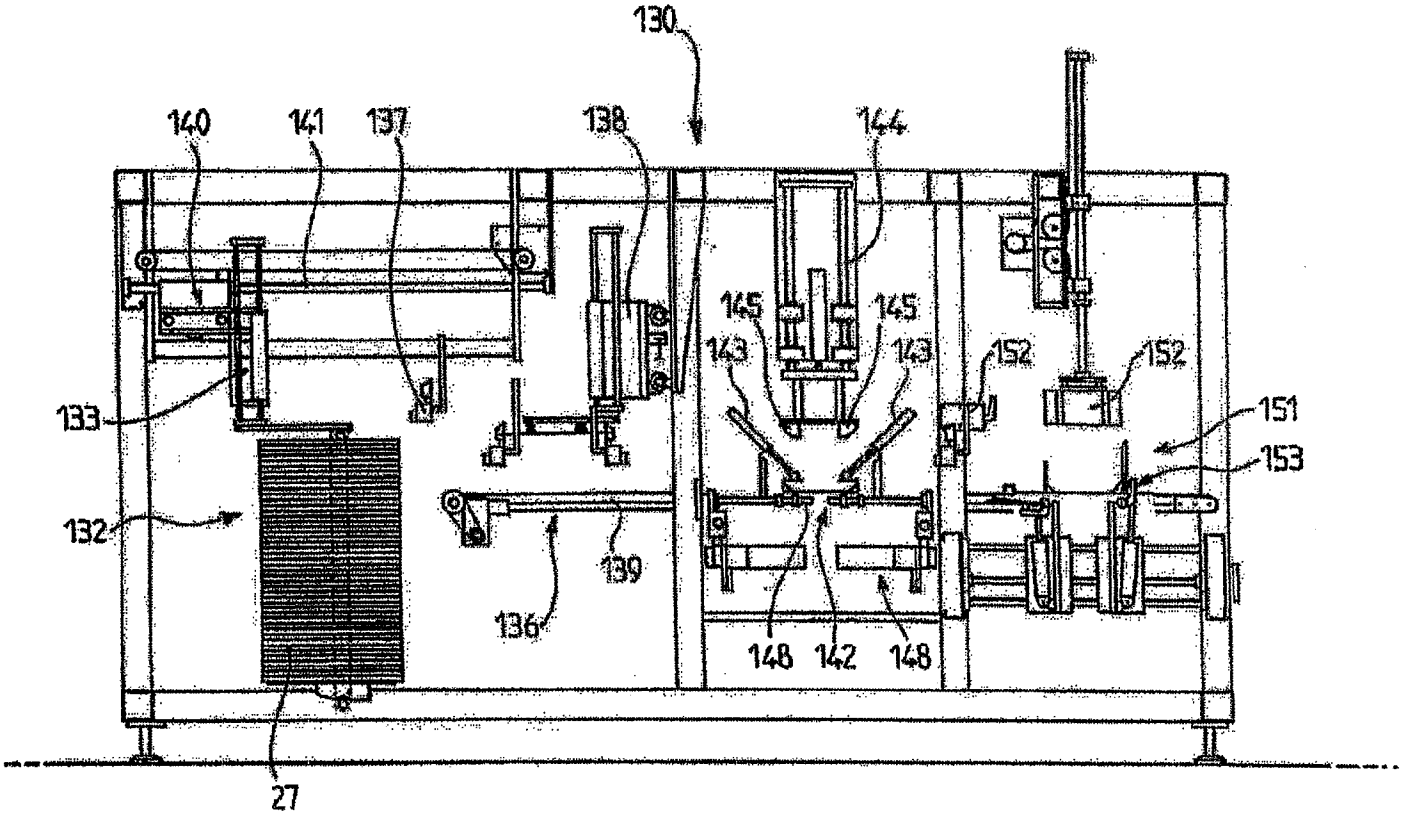
Figure 29:
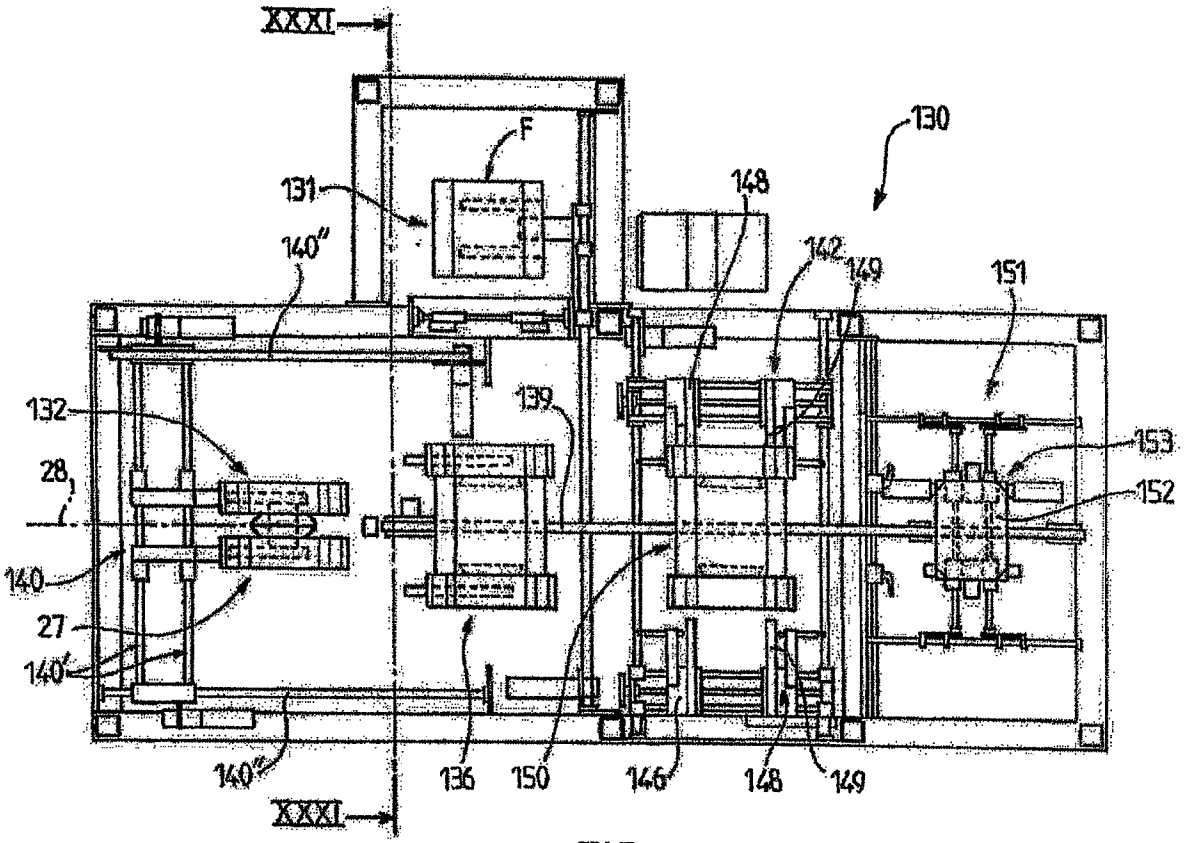

FIGS. 28 and 29 show in side view and in top view an embodiment of a device according to the invention, with mandrill.

Figure 30:
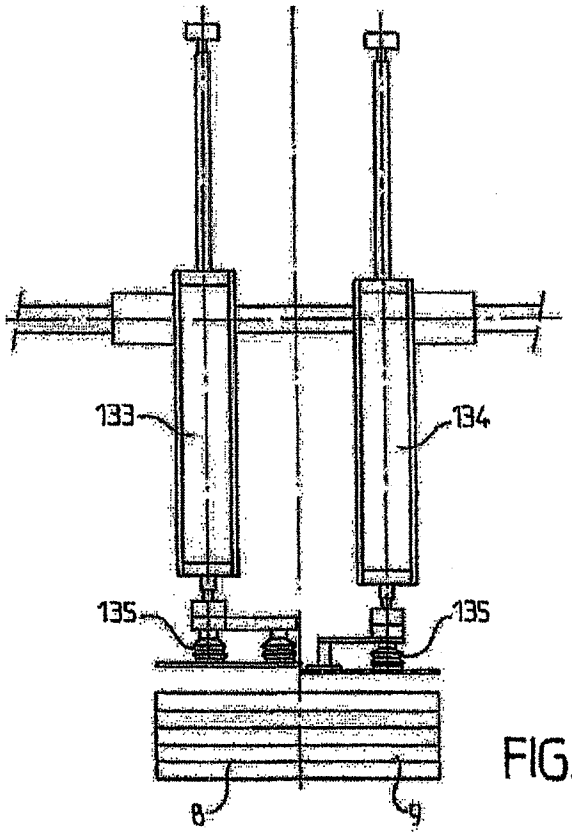

FIG. 30 is a side view of the magazine-separation of the blanks in order to form the second parts of the device described with reference to FIGS. 28 and 29.

Figure 31:
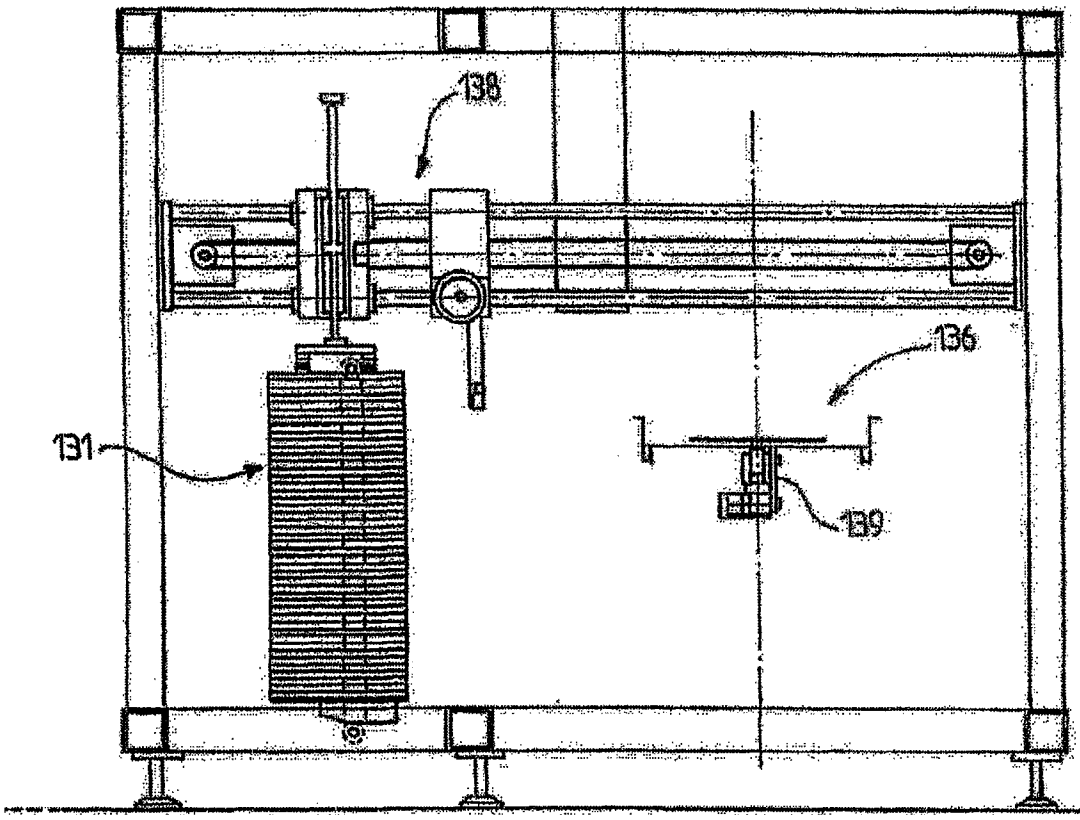

FIG. 31 is a side view of FIG. 29 along section XXXI-XXXI.

Figure 32:
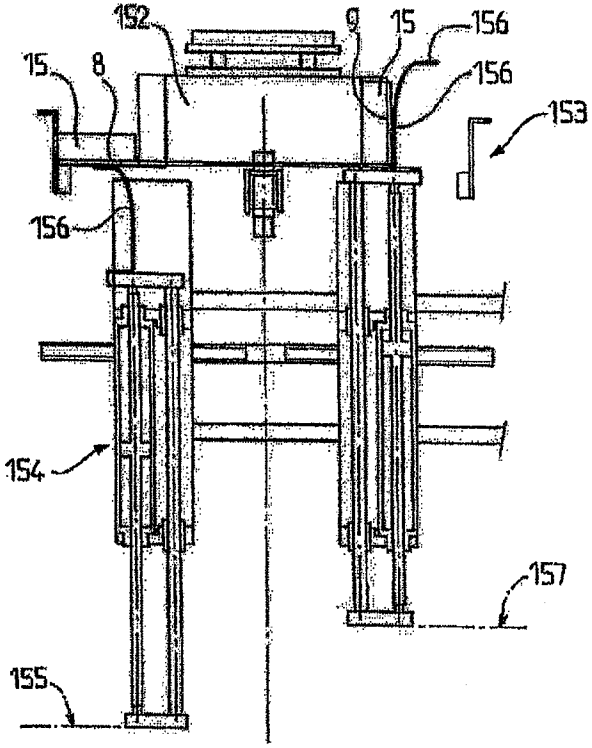

FIG. 32 is a side view of the station for assembling around the mandrill.

Figure 33:
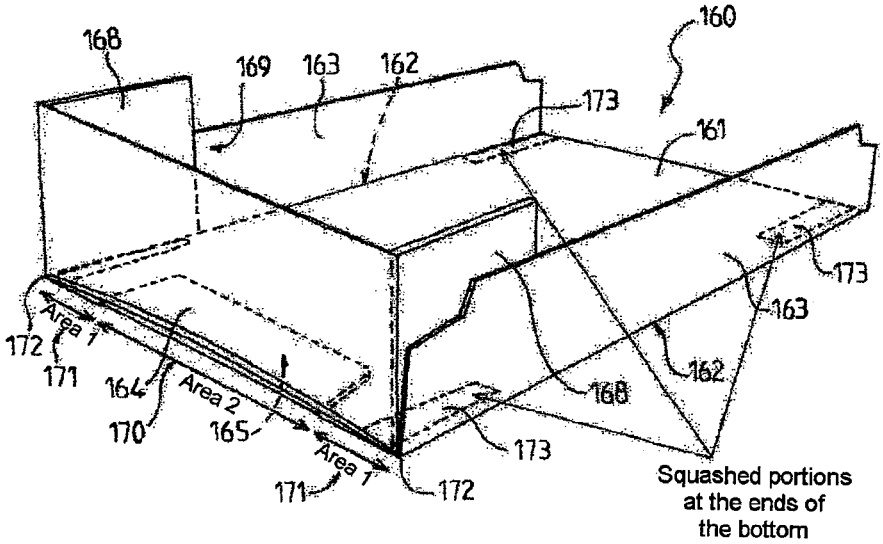

FIG. 33 is a partial view in perspective of another embodiment of a tray according to the invention.

Figure 34:
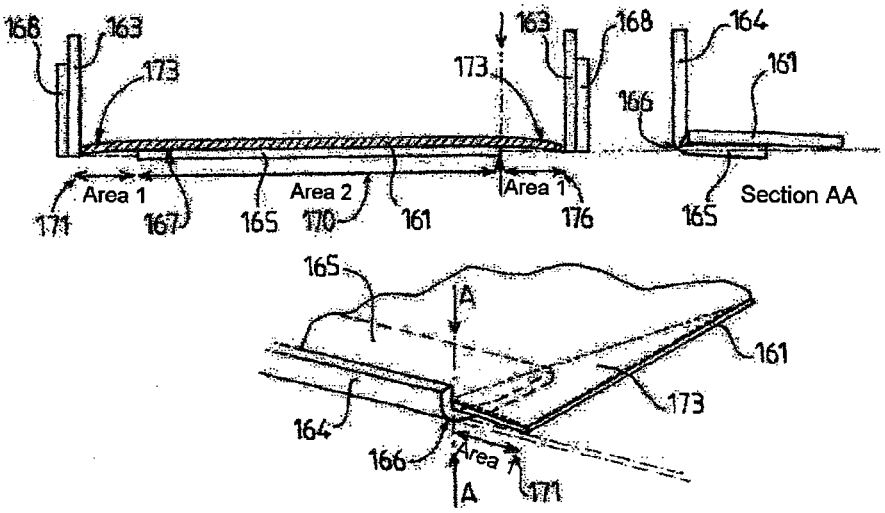

FIG. 34 shows views in section and in perspective of the bottom of the tray of FIG. 33.

Figure 35:
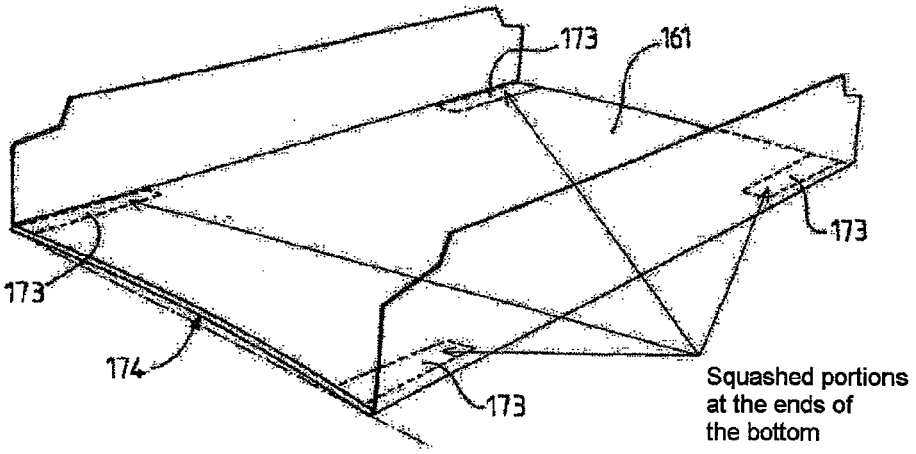

FIG. 35 is a view in perspective of a bottom according to one embodiment of the invention similar to that of FIG. 33.

Figure 36:
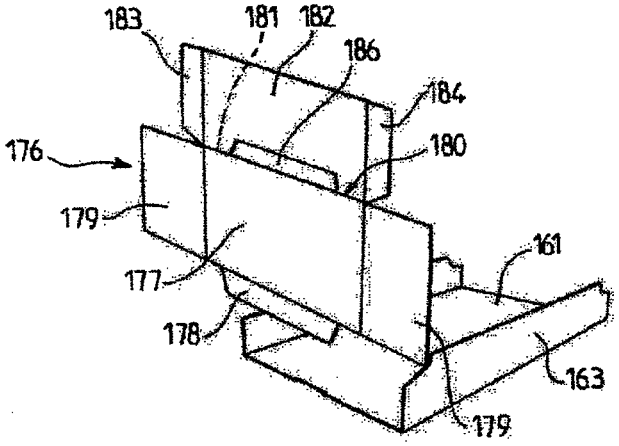

FIG. 36 is a view in perspective of a half-tray being formed using the bottom of FIG. 35 and a half-blank according to another embodiment.

Figure 37:
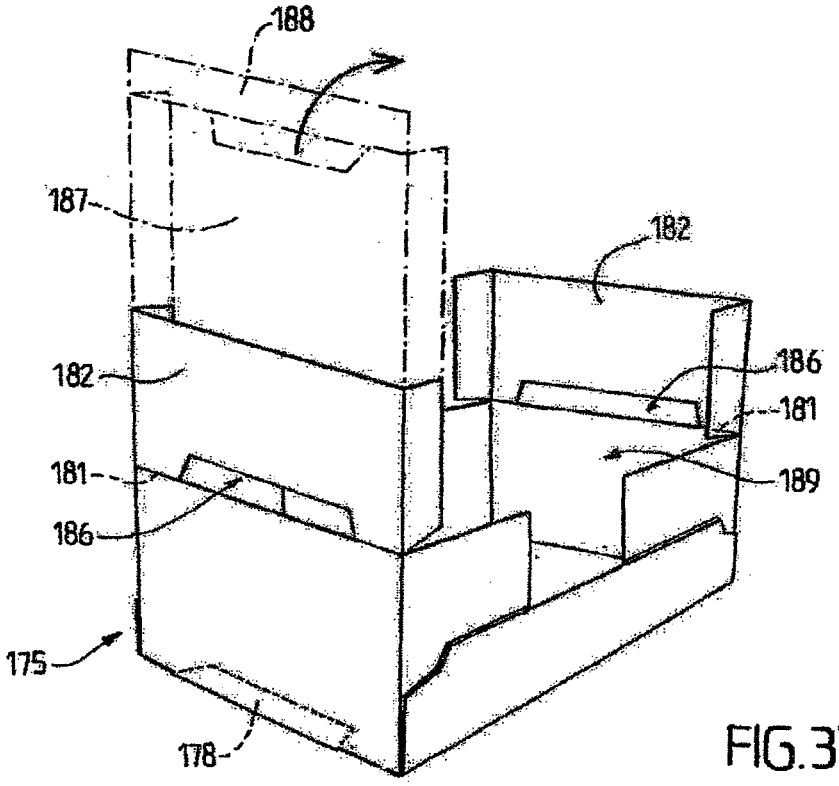
Figure 38:
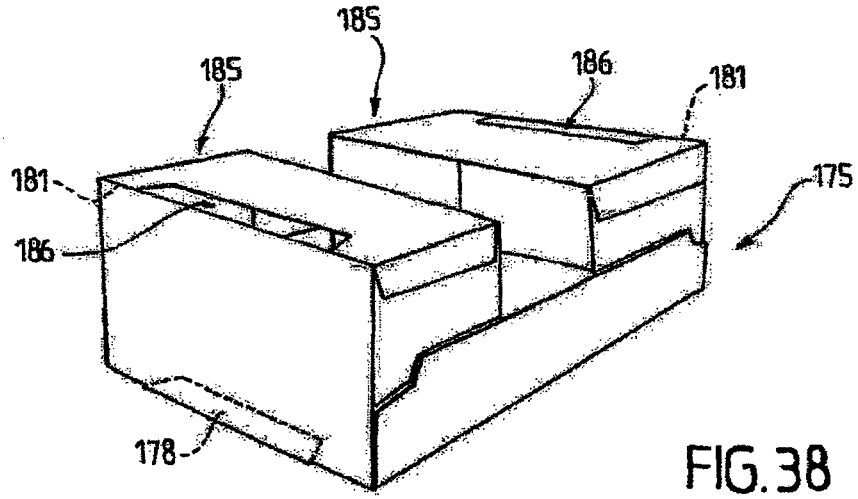

FIGS. 37 and 38 show in perspective the tray obtained with the bottom and blank of FIGS. 35 and 36, in the course of formation and when finished.

In the rest of the description of the figures, the same reference numbers will be used to indicate identical or similar elements.

Figure 1:
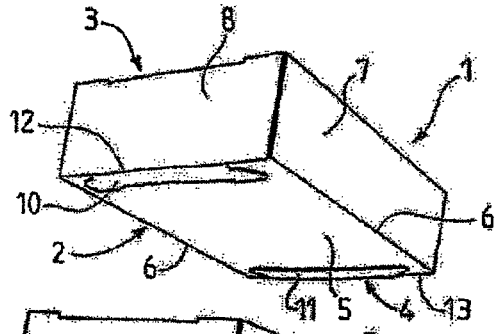
Figure 2:
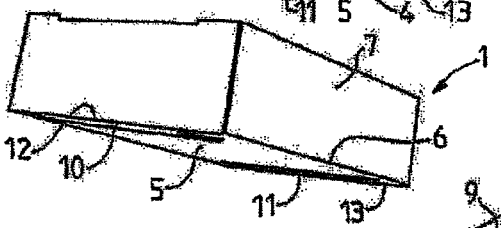
Figure 2:
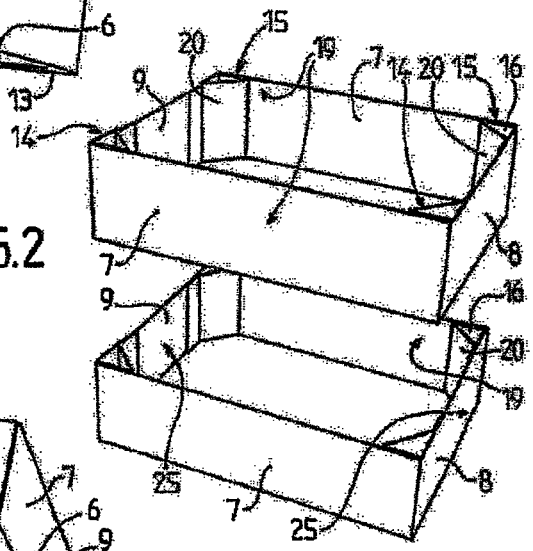
Figure 3:
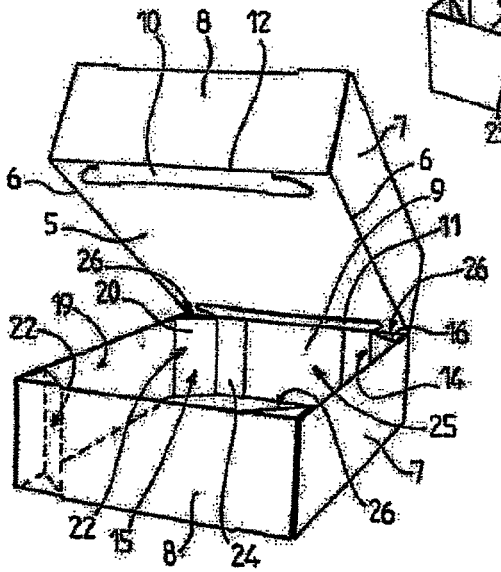

FIGS. 1 to 3 show two identical parallelepipedal, superposed trays 1 made of cardboard sheet material according to a first embodiment of the invention.

Each tray 1 is formed of three separate parts 2, 3 and 4, namely a first part 2 forming a bottom 5 connected by first fold lines 6 to two first side walls 7 and two second parts 3 and 4 forming two second opposite side walls 8 and 9 each comprising a first longitudinal flap 10, 11 connected to said second wall 8, 9 by a second fold line 12, 13 that is advantageously slightly offset to compensate for thicknesses of cardboard, at least in part, and bonded to the lower face of the bottom 5.

Each second wall 8, 9 comprises two sets of transverse flaps 14, 15 each comprising at least one transverse flap 16 respectively bonded to the inner face of a corresponding first side wall 7 facing it.

More precisely, on the tray shown in FIGS. 1 to 3 and with reference also to FIGS. 4A, 4B and 6A, 6B, each set of flaps 14, 15 comprises a first transverse flap 17 connected to the corresponding second side wall 8, 9 by a third fold line 18 and bonded to the inner face of the adjacent first side wall.

Each set of flaps 14, 15 also comprises second, rectangular transverse flaps 20 connected by a fourth fold line 21 to said first transverse flap (see FIGS. 3, 4A and 6A), said second transverse flaps each themselves being connected by a fifth fold line 23 (parallel to the second fold line) to a third transverse flap 24 interacting with the inner face 25 of the second walls facing them to form a corner pillar 22 (see FIG. 4A) of the tray.

As shown in FIG. 3, it can moreover be seen that the first flap 11 is arranged to fit between the upper portions 26 of the sets of transverse flaps 14, 15 forming a corner pillar.

This fitting stems notably from the fact that since the flaps 10 and 11 are bonded to the bottom 3 of the tray above they protrude relative to the bottom, which therefore allows a fitment with the upper periphery of the pillars while allowing a self-centering and a lateral immobilization of one tray over the other.

It can be understood therefore that the existence of these flaps bonded to the lower outer face of the bottom allows excellent stacking of the trays on one another.

Figures 4A, 4B, 5A, 5B, 5C:
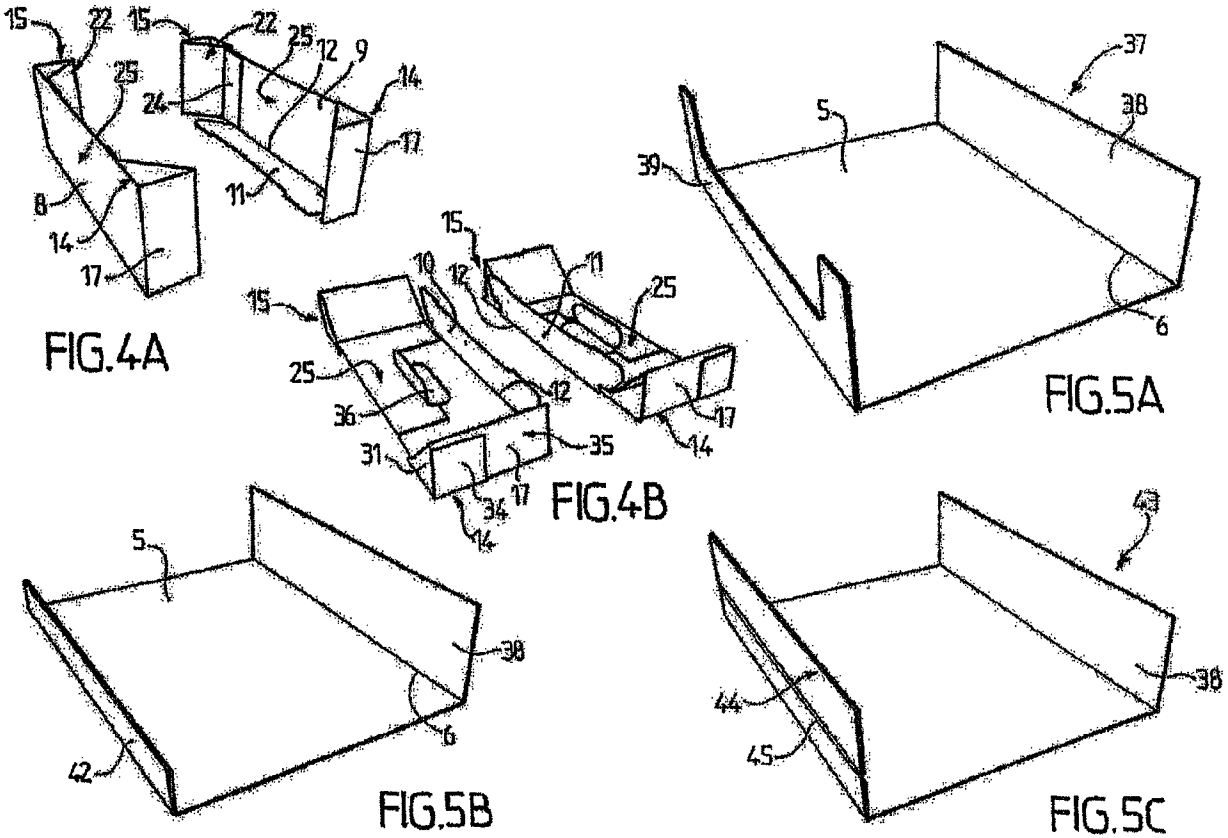
FIGS. 4B and 6B show another embodiment, respectively in perspective and flattened out, of a set of blanks for side wall according to the invention.
FIGS. 5A, 5B and 7A, 7B are views, respectively in perspective and flattened out, of blanks making it possible to obtain a bottom part according to two embodiments of the invention.
Figures 6A, 6B, 7A, 7B, 7C:
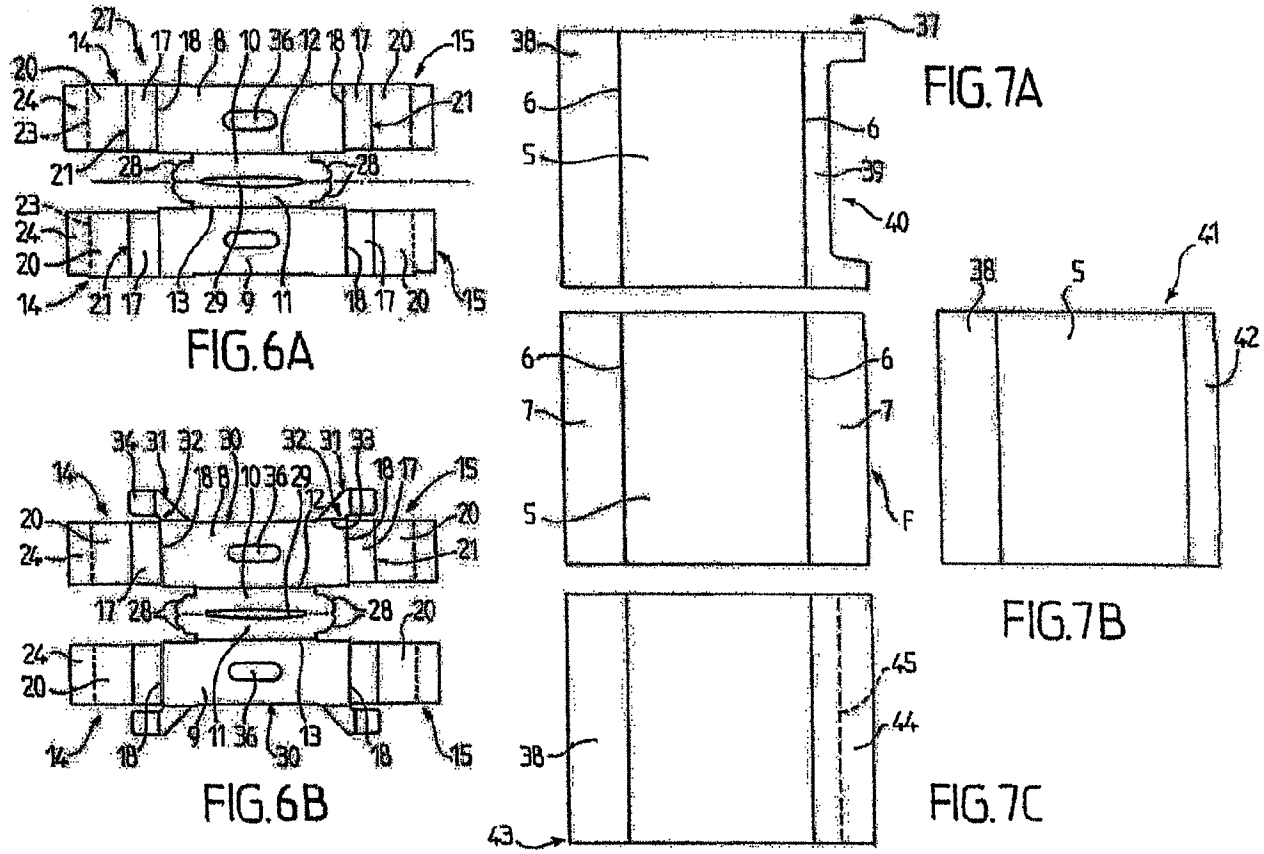

More precisely, and still with reference to FIGS. 4A and 6A, note that the two parts 3, 4 are obtained from one and the same blank cut-out 27 (see FIG. 6A) that is symmetrical relative to a blank cut-out line 28.

The first longitudinal flaps 10, 11 are of substantially trapezoidal shape, the small base being formed by the second fold line 12, 13 and the large base itself having the dimension smaller than the total length of the second wall (8, 9) to which the first flap 10, 11 is attached, the respective lateral sides 28 of said first flap being for example nose-shaped in order to allow the fitting by their matching shape with the space between the pillars of the tray above.

A recess 29 between the first two adjacent flaps 10, 11, that are symmetrical relative to the oblong blank cut-out line 28, is advantageously provided.

FIG. 4B or 6B show a variant embodiment of the second parts which also comprise, on the outer peripheral edge 30 of the second walls, two triangular or trapezoidal tongues 31 directed outward and connected respectively by fold lines 32 to each end of said periphery of the second walls.

The tongues 31 are themselves extended laterally by a small rectangular tongue 34 situated level with the first transverse flap 17 which makes it possible (see FIG. 4B), when the second wall is formed with its corner pillars, to cover the outer face 35 of the first transverse flap 17 thus allowing a consolidation of the assembly.

According to the embodiment of FIGS. 4B, 6A, 6B, also shown substantially centered on each second wall 8, 9, is an oblong hole 36, obtained by cutting out, allowing the tray to be taken hold of.

FIGS. 5A to 5C and 7A to 7C show three embodiments of first parts that can be used with the invention.

FIGS. 5A and 7A show a blank 37 comprising a rectangular bottom 5 and two first opposite side walls connected to said bottom by the fold lines 6, namely a first vertical rectangular wall 38 of the height of the tray and a first U-shaped wall 39 comprising a central recess 40.

In other embodiments (FIGS. 5A and 7B), the first bottom part 41 comprises a first wall 42 of lesser height than the wall 38 facing it, which allows the tray to be opened laterally, or on the contrary two walls 7 of the same height (see FIGS. 1 to 3).

Finally, in another embodiment of first parts 43 and with reference to FIGS. 5C and 7C, a first wall 44 is provided furnished with a tear-off tongue 45 shown in dashed lines in FIG. 7C making it possible to open the tray on one side in order to have access for example to its content.

Figure 8B:
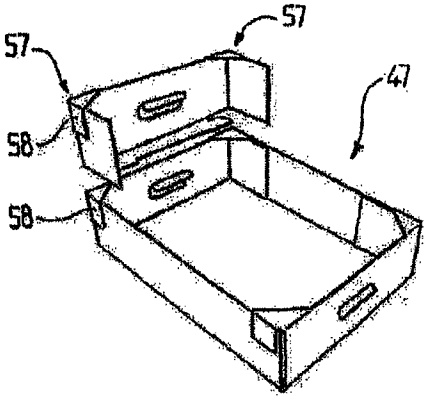
FIGS. 8A, 8B and 9A, 9B show other embodiments of trays and of blanks for corresponding second side walls, according to two other embodiments of the invention on the one hand with protruding elements and on the other hand with corner braces.
Figure 9B:
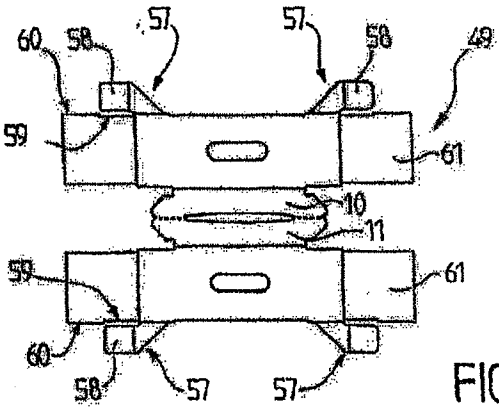
Figure 8A:
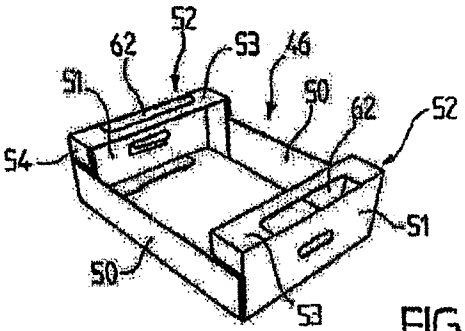
Figure 9A:
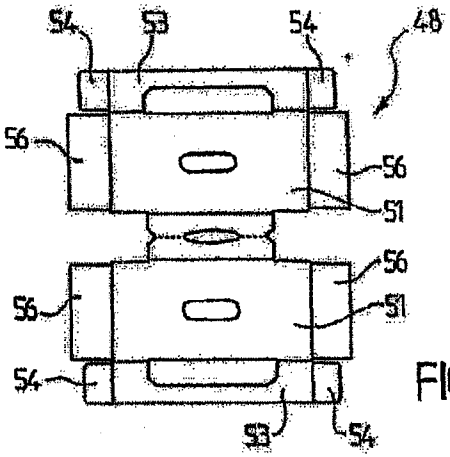

Shown in FIGS. 8A and 8B are two other embodiments of trays 46 and 47 according to the invention, and shown in FIGS. 9A and 9B are the blank cut-outs 48, 49 for corresponding second parts.

More precisely, FIG. 8A shows a tray 46 of which the two first side walls 50 are of lesser height than those of the second side walls 51.

The latter, for their part, comprise on their upper periphery 52 second longitudinal flaps 53 suitable for forming rectangular horizontal protruding elements and comprising on each side two small, square, lateral tongues 54 folded down on the outer face of the corresponding first transverse flap 56 of the second wall in question.

FIGS. 8B and 9B, for their part, show a tray 47 with corner element 57 formed by two small tongues 58 like those described with reference to FIG. 6B. Small notches 59 in the upper periphery 60 of the first transverse flaps are provided to prevent overlaps.

These elements will notably allow fitment with the first flaps facing them protruding from the bottom of the tray.

In the embodiment of FIGS. 8A and 8B, the top of the protruding elements 53 comprises a recess 62, or else a space between the corner elements 57, of a shape to match the shape of the first protruding flaps in order to allow fitment.

FIGS. 10A, 10B, 10C and 11 show another embodiment of a tray 63 according to the invention which in this instance also comprises protruding elements 64 in the upper portion formed by second rectangular longitudinal flaps 65 connected to the upper longitudinal periphery 66 of the second rectangular walls 67 and the first transverse flaps 68 comprising, for their part, small triangular tongues 69 closed and bonded to the top of the flap forming the protruding element described above.

The fitment is in this instance possible between these two small triangular tongues 69 and the first flap of matching shape.

Figure 13:
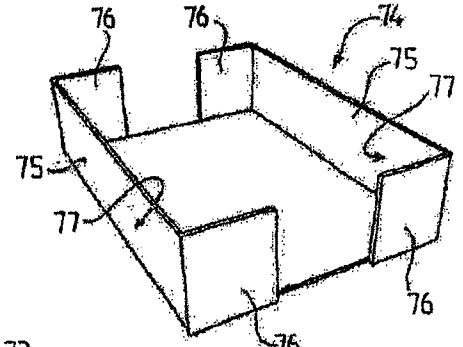
Figure 12:
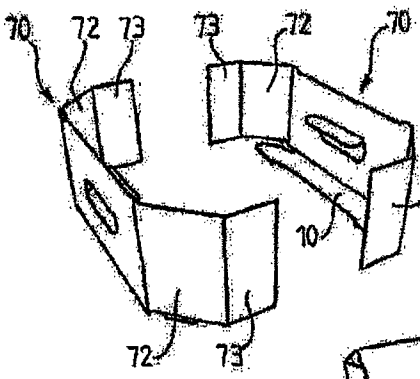
FIGS. 12 and 15 show in perspective two other embodiments of second parts according to the invention that can be combined with the first bottom part in perspective of FIGS. 13 and 14.
Figure 15:
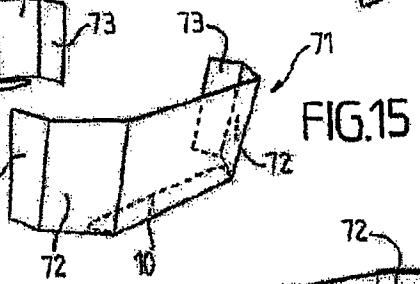
Figure 16:
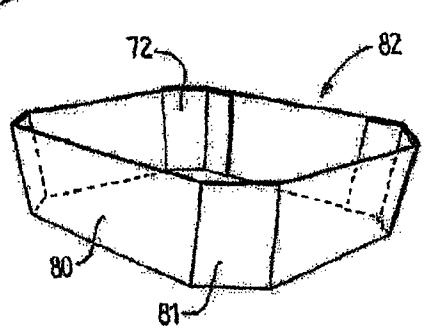
FIG. 16 is a view in perspective of a tray obtained by bonding the blanks of FIGS. 14 and 15 together.

FIGS. 12 and 15 show in perspective and in plan view two other embodiments of second walls 70 and 71 according to the invention comprising two first transverse flaps 72 connected to two second transverse flaps 73, these embodiments allowing bonding inside a first part 74 of the type of FIG. 13, that is rectangular, itself comprising two first rectangular walls 75 furnished at each of their respective ends with a tongue 76 that is also rectangular, the second walls 71 of FIG. 15 therefore being arranged so that their second flap 73 is bonded to the inner faces 77 of the first walls of the package.

Figure 14:
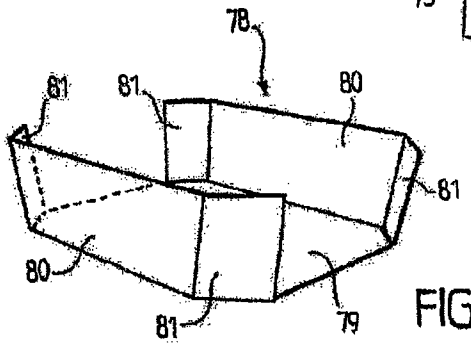

In another embodiment (FIG. 14), the first part 78 comprises an octagonal bottom 79 and each first wall 80 comprises end tongues 81. The second walls 71 are then bonded to this first part so that it forms a tray 82 with eight sides, the first transverse flaps 72 themselves being bonded to the end tongues 81 of the first walls 80 of the first part.

Figure 18:
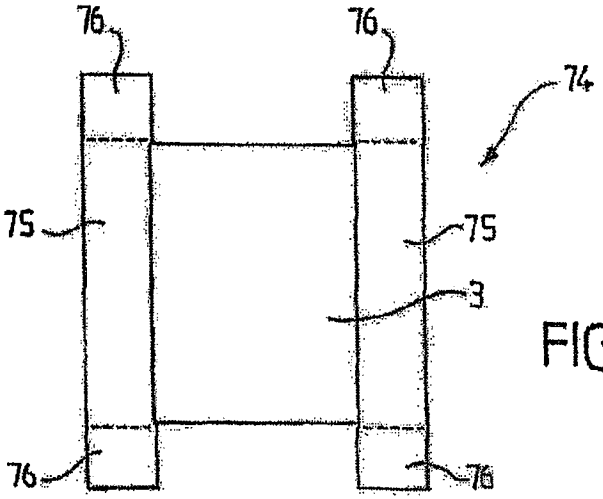
FIGS. 17, 18 and 19 show flattened out the blanks corresponding respectively to the formed blanks of FIGS. 12, 13 and 14.
Figure 19:
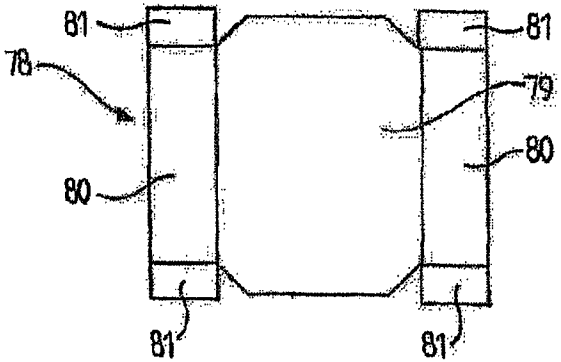
Figure 17:
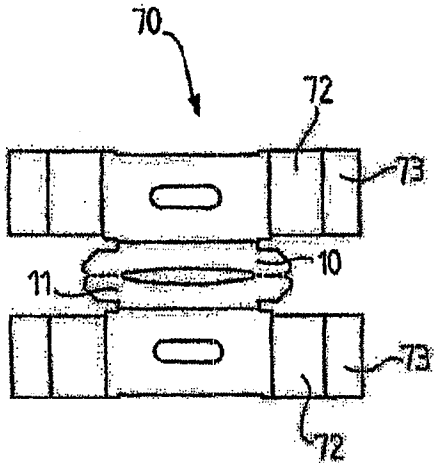

FIGS. 17 to 19 show blanks for second parts (FIG. 17) and first parts (FIGS. 18 and 19) making it possible to produce the elements respectively of FIGS. 12 and 15 and 13 and 16.

Figure 20B:
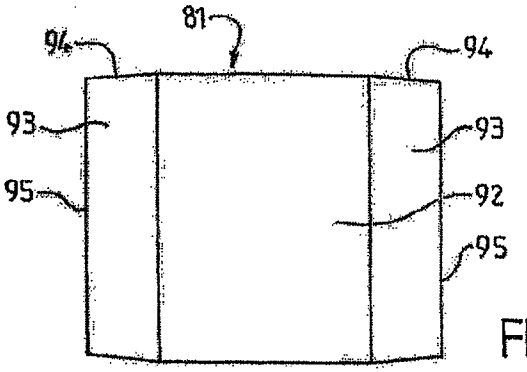
FIGS. 20A and 20B show blanks respectively for second part and first bottom part making it possible to obtain the frustoconical trays being assembled and stacked shown in FIGS. 21 and 22.
Figure 20A:
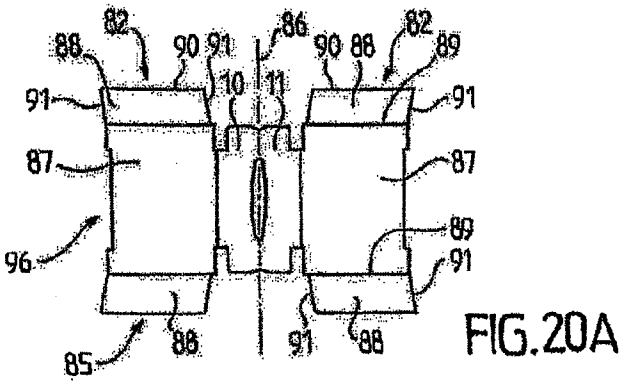
Figure 22:
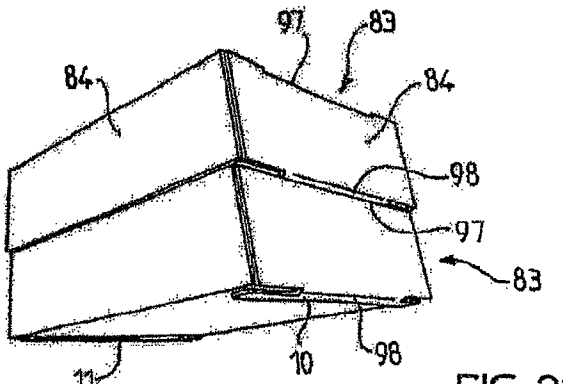
Figure 21:
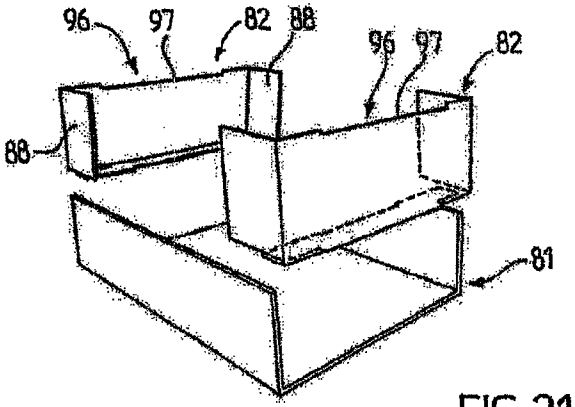

Shown in FIGS. 20A to 21 are other embodiments of first parts 81 and second parts 82 according to the invention making it possible to form a frustoconical tray 83 with walls 84 inclined inward (or outward) making stacking easier.

More precisely, a blank 85 is proposed formed of two second parts 82 that are symmetrical relative to a central axis 86 comprising second rectangular walls 87 furnished with the first longitudinal flap 10, 11 like those described with reference to the preceding figures and on either side two transverse flaps 88 of trapezoidal shape, namely comprising a first side 89 formed by the fold line and connected to its second outer peripheral side 90 by two parallel sides 91 inclined outward, on the side opposite to the first longitudinal flap 10, 11.

For its part, the first part is then formed of a rectangular bottom 92 furnished with the two first walls 93 which themselves comprise lateral sides 94 sloping inward to form isosceles trapeziums of which the small side 95 is formed by the outer peripheral edge.

These upper edges 96 of the second walls 87 comprise notches 97 capable of fitting into the edges 98 of the longitudinal flaps 10 and 11 overlapping.

Figure 23B:
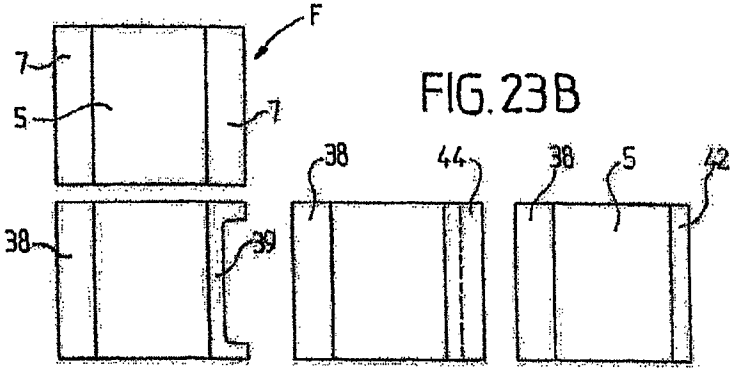
Figure 23A:
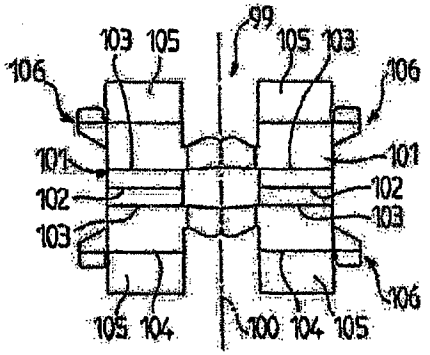
Figure 25:
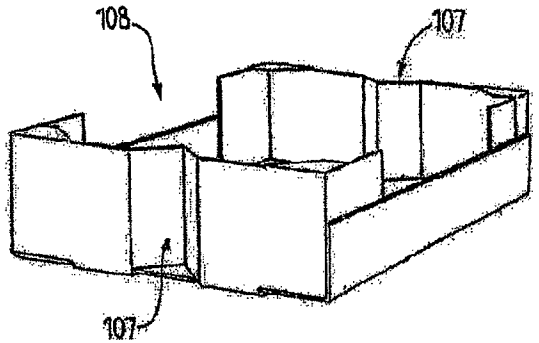
Figure 24:
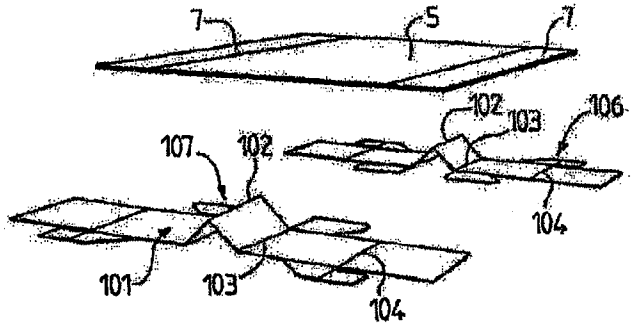

FIGS. 23 to 25 show another embodiment of the invention. The first part (FIG. 23B) is for its part formed by blanks similar to those described with reference to FIGS. 7A to 7C.

The second blank 99 making it possible to produce the second walls is for its part formed symmetrically on either side of a line of separation 100, by a first rectangular tab 101 furnished at its centre with a fold line around which are situated on either side and symmetrically two parallel fold lines 103, then the third fold line 104 for attachment to the first transverse tabs 105, the outer upper periphery of this second wall also comprising tongues 106 of the type described with reference to FIG. 9B or 6B.

The second walls, once separated relative to their junction line (see FIG. 24), are folded so that the central portion 107 forms an isosceles triangle, the dimension of the second wall, once puckered in its middle, being equal to the length of the first wall.

The tray 108 is then formed in a manner similar to the previous packages.

A description will now be given, more precisely with reference to FIGS. 26A through 26G, of the method for manufacturing a tray according to one embodiment of the invention, of the type described with reference to FIGS. 1 to 3 and 4A and 5C.

From two blanks of corrugated cardboard sheet material, namely a first blank F formed of a bottom 5 connected by first fold lines 6 to two first opposite side walls 7 and a second blank 27 suitable for forming two second opposite side walls 8, 9, identical and symmetrical relative to the line of separation 28, each second side wall comprising at least one first longitudinal flap 10, 11 connected on one side to a corresponding second wall 8, 9 by a second fold line 12 and on the other side by said line of separation 28 to the outer periphery of the other first longitudinal flap of the second symmetrical side wall facing it, and two sets of transverse flaps 14, 15 each comprising at least one transverse flap 24, the second blank is cut (step 110) at the line of separation 28 to form the two second parts.

The two second parts are then transferred (arrow 111) to an assembly station 112 while bonding on the way the inner faces of the walls 8, 9 and the flaps 10, 11 and 24 with adhesive called "hot melt" adhesive in a manner known per se.

Figures 26A, 26B:
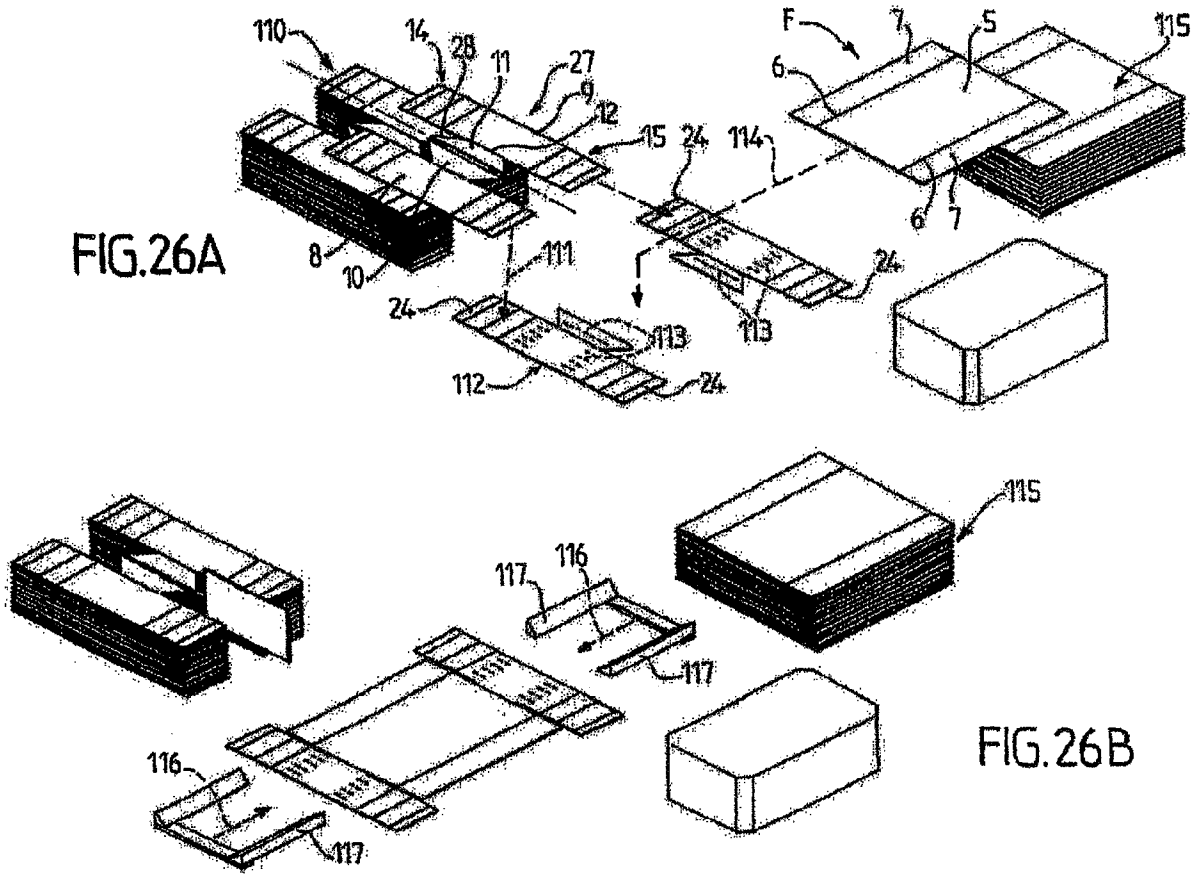

Then the first blank F is transferred (arrow 114) from its constant-level vertical stack 115 and the blank is pressed onto the flaps 10 and 11 as shown in FIG. 26B. The transfers are carried out laterally by suction cup.

Then the elements 117 are brought (arrow 116) which will allow the folding of the corner pillars and which will be described more precisely below with reference to the device.

Figure 26C:
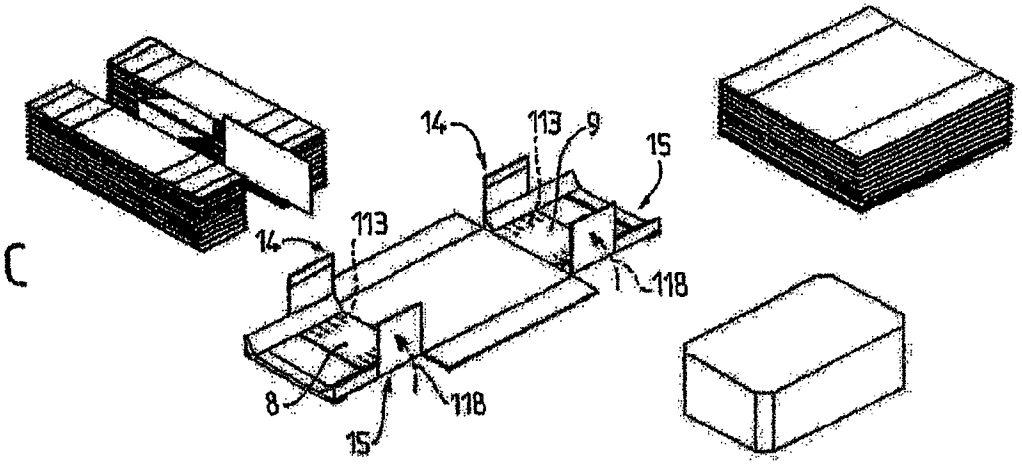
Figure 26D:
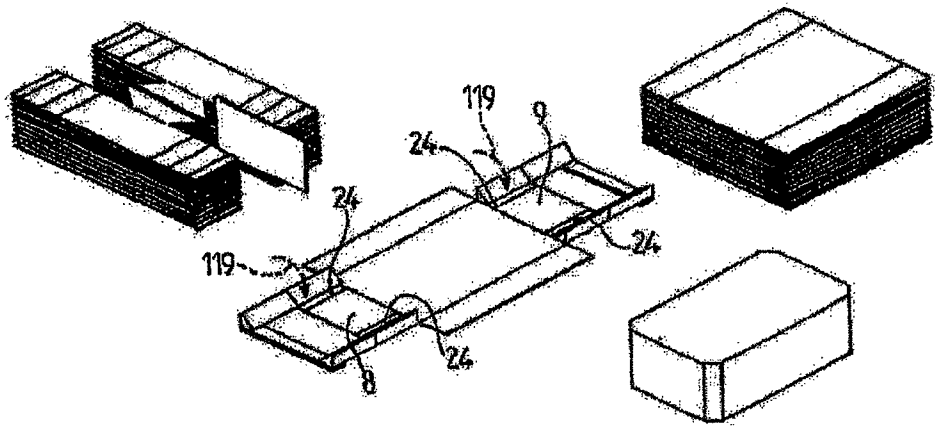
Figures 26E, 26F, 26G:
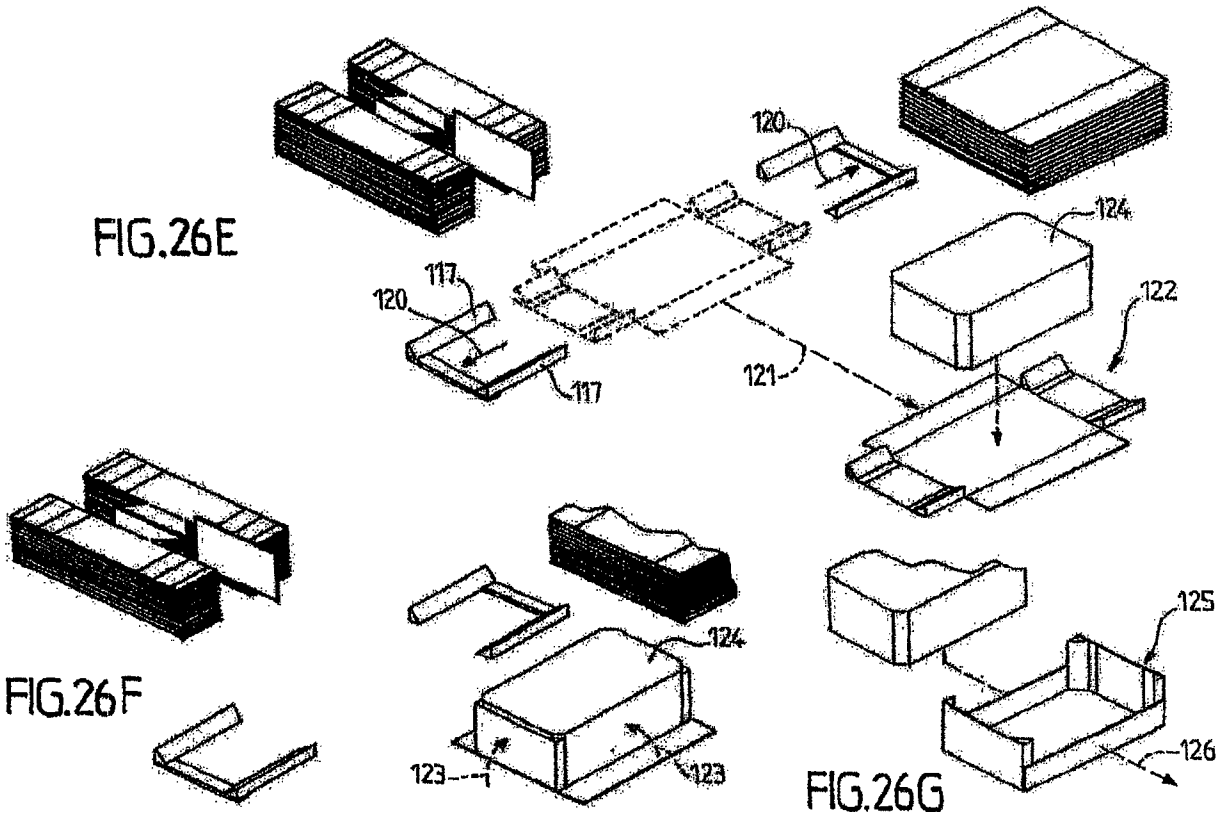

With reference to FIGS. 26C and 26D, the sets of flaps 14 and 15 are folded (arrows 118 and 119) toward the second adhesive-coated walls (see FIG. 26D), then (see FIG. 26E), after withdrawal (arrow 120) of the elements 117, the set of blanks thus formed is transferred (arrow 121 of FIG. 26E) to a forming station 122 in order to wind it (arrow 123, see FIG. 26F) around a mandrill 124 with eight sides in order to form the tray 125 (see FIG. 26G).

FIGS. 27A and 27B show the main steps of a different embodiment of the method according to the invention using a retractable mandrill 127 of the type known per se for example comprising four stops 128 that can be moved between an outspread position (FIG. 27A) and a retracted position (FIG. 27B) for extraction (arrow 129) making it possible to escape from the rims 57 of the trays 47 of the type described with reference to FIG. 8B and/or the protruding elements with reference to FIG. 8A.

Shown now with reference to FIGS. 28 to 32 is a device 130 for forming a tray according to the embodiment of the invention more particularly described here.

The device comprises two storage magazines 131 and 132 for storing the first blanks F and second blanks 27, said magazines being formed by elevator carriages on which the blanks are held firmly and stacked flat, the carriage rising gradually as the stack is depleted.

The storage magazine for the second blanks is moreover furnished with a cutting blade (not shown) for cutting the second blank into two symmetrically at the line of separation 28.

Two extractor arms 133 and 134 (see FIGS. 28 and 30) formed by pistons and furnished with suction cups 135 are used to separate one of the blanks from the other, their separation and their transfer to the assembly station 136 with adhesive-coating by means 137 known per se.

The first blank F is for its part brought laterally by means of a carriage 138 to the assembly station comprising a transfer conveyor 139.

More precisely, with reference to FIG. 28, the magazine for separation of the second side walls comprises a gripper carriage 140 for bringing to the assembly station, shown on a beam 140' resting on either side on two running rails 140".

It comprises the two arms 133, 134 for widthwise positioning. This gripper carriage is actuated by a drive belt 141 for the transfer to the assembly station.

Means for adhesive coating 137 of the blanks for assembly are provided during the travel of the second blanks.

They are for example formed of adhesive-coating guns known per se.

Once the blank is in position on the transfer conveyor 139, a transfer stop (not shown) at the different stations allows the assembly thus firmly held to be picked up to bring it to the next station.

The device 130 furthermore comprises a station 142 for forming the dihedrons or corner pillars and more particularly a system for forming and pressing the dihedrons comprising pistons 143 and a carriage 144 for lowering a part comprising dihedrons 145 formed for placing in counter pressure.

A system 146 for folding the dihedrons to 90° by pusher piston is also provided, the carriages 148 for bringing the beams 149 of triangular cross section for formation of the dihedrons in motorized manner also being provided beneath the forming station.

Pre-assembly adhesive-coating guns that are adjustable by slide rail are positioned appropriately, a system (not shown) for vertical folding of the type described with reference to FIG. 32 also being provided.

It therefore comprises vertical arms 150 that are rounded in the upper portion to facilitate docking and to push away the vertical flaps.

Once the beams are formed, the carriages 148 for bringing the beams 149 for forming dihedrons are withdrawn and the assembly is pushed by means of the conveyor 139 toward the forming station 151 around the mandrill 152.

Here again, pre-assembly adhesive-coating guns (not shown) are provided in a manner known per se, and a system 153 for folding and pressing the bottom that is adjustable in two directions by a screw system.

The system 153 is arranged to press the vertical walls of the tray onto the side faces of the mandrill 152 brought down from above.

Note that the latter can be changed at the format level.

The system 153 comprises an element 154 arranged to move between a low position 155 of escapement from the vertical strips 156 with horizontal curved end 156' and a high position 157 for pressing the strips onto the walls 8 and 9 on the one hand and 7 on the other hand for bonding with the outer faces of the corner pillars 14, 15.

The operation of the device according to the embodiment of the invention more particularly specified here will now be described.

The second parts or end blank cut-outs are unstacked one by one from the constant-level magazine 132.

The two peripheral edges of the two first longitudinal flaps 10 and 11 being connected by attachment points, the unstacking is carried out by the two systems represented in FIG. 30 driven and fitted with suction cups, one at each end.

Each unstacker has a different high point which makes it possible to release the attachment points and thereby to separate the two distinct second parts or end blank cut-outs.

These end blank cut-outs are transferred to the coupling station 136, and during this transfer the connecting panels are adhesive-coated and placed in widthwise position by the two independent onboard carriages 140 controlled by servomotors.

The ends are then positioned at the coupling station which comprises a conveyor belt 139.

At the same time, a bottom blank cut-out and/or first part is extracted from the constant-level magazine 131.

The transfer of the bottom blank cut-out is carried out at the coupling station by means of a carriage 138 also controlled by servomotors.

During this transfer, an onboard bonding system places the adhesive necessary for creating the dihedrons of the ends.

The bottom is then placed under pressure on the ends and the assembly is transferred to the dihedron-forming station.

The dihedron-forming station 146 includes the positioning of four counter-forms corresponding to the dimension of the dihedrons (two right-hand systems and left-hand systems controlled by servomotors).

Then the dihedrons are positioned vertically around their scoring (fold lines) by a ramp and the dihedrons are placed horizontally around their complementary scorings by a dynamic system and finally the dihedrons are formed and placed under pressure around the next scorings by a tool comprising pistons 143 and then the counter-forms are withdrawn.

Then the transfer to the assembly station is carried out.

During this transfer, the bottom is adhesive-coated.

The tray is then assembled by lowering of the mandrill (internal) onto the flat tray and the ends of the walls 8 and 9 are then placed vertically, followed by the bottom panels 7 before the tray is placed under pressure and then ejected.

Note that, in the case in which the ends are fitted with total or partial protruding elements, they are formed at the assembly station, the internal mandrill then being retractable in order to allow its disengagement.

FIGS. 33 and 34 show a tray portion 160 comprising a rectangular bottom 161 connected by the first fold lines 162 to two first substantially rectangular walls 163. The tray also comprises two second rectangular side walls 164 (only one is shown in the figure) comprising a rectangular longitudinal flap 165 connected to said second wall by a second fold line 166 in a manner centered on a portion of the length of the wall, for example ⅔ or ⅘ and bonded to the outer face 167 of the bottom, and two transverse flaps 168 bonded to the inner face 169 of the first walls 163 facing them.

As can be seen in the figures, the area of cardboard of the bottom at the second fold line is divided into three portions namely a central area 170 facing the longitudinal flap 165 and two areas 171 situated on either side of the edges of the flap and the first walls.

In order to minimize the extra thickness of the flap bonded on the underside of the bottom in the area 170 and formed so that the bottom deforms vertically to allow the border of the flap to be aligned with the clean borders 172 of the areas 171, areas 173 are provided substantially in the form of tongues along or at the edge of a portion of the first fold line, for example having a width equal to half that of the area 171 and being long enough to obtain a good elasticity, for example a few centimeters depending on the thickness of the cardboard.

This localized squashing of the cardboard at the ends of the bottom thus allows a slight bowing (see FIG. 35, arrow 174) so that the points of contact of the vertical wall on the areas 171 are in line with those of the area 170. Thus all of the vertical walls formed by the first walls and the second walls participate in a similar manner in the compression, significantly increasing the VCR.

FIGS. 35 to 39 show the partial elements, in perspective, in the course of formation, or formed, of a tray 175 according to another embodiment of the invention.

FIG. 35 shows a bottom 161 like that described with reference to FIG. 33.

FIG. 36 shows in perspective the bottom 161 and a half-blank 176. The half-blank 176 making it possible to obtain the second side walls comprises a second rectangular wall 177, furnished with the longitudinal flap 178, capable of being bonded to the bottom, in the form of a tongue, with two lateral rectangular flaps 179 on either side, and on the other side with an outer edge 180, forming a fold line, of junction 181, with a third rectangular tab 182 with a length equal to that of the flaps 179, for example with a length equal to ⅓ of the length of the first side walls 163, furnished with two rectangular flaps 183, 184 capable of being folded onto the flaps 179 in order to form the protruding elements 185 (see FIG. 38).

Recesses 186 on the fold lines 181, in the tab 182 of a shape to match the tongues 178, to allow fitment, are provided.

In one embodiment shown in dot and dashed lines in FIG. 37, the tab 182 is replaced by a tab 187 capable of forming the top of the tray and of being closed by a tongue 188 on the second wall 189 facing it.

It goes without saying and it also results from the foregoing that the present invention is not limited to the embodiments more particularly described. On the contrary, it covers all the variants thereof and notably those in which the blanks of the first side walls and of the bottom are of high basis weight, for example 100 g/m$^2$, and that of the second walls and of low basis weight for example less than 50 g/m$^2$, those in which the forming station is different, the formation of the tray being carried out by pressing in a manner known per se, or other methods not using a mandrill, those in which the side squashed areas allowing bowing are replaced by a central squashed area, the tongue 178 then being situated for example inside the box, bonded to the inner face of the bottom.

The invention claimed is:

1. A tray made of cardboard sheet material, formed of three separate parts, namely a first part forming a bottom having an external face connected by first fold lines to two first opposite side walls, each first side wall having an inner face, and two second parts forming two second opposite side walls each comprising at least one first longitudinal flap connected to said second wall by a second fold line and bonded to the external face of the bottom and two sets of transverse flaps each comprising at least one transverse flap respectively bonded to a corresponding first side wall facing it, wherein each set of transverse flaps comprises a first transverse flap connected to the corresponding second side wall by a third fold line and bonded to the inner face of the adjacent first side wall, and wherein the side ends of the first longitudinal flaps bonded to the external face of the bottom of the tray are of a shape to match an upper surface of the tray or second longitudinal flap(s), in order to allow one to fit into the other when two trays are stacked on one another.

2. The tray as claimed in claim 1, wherein each set of transverse flaps comprises a second transverse flap connected by a fourth fold line to said first transverse flap to form a corner of the tray, said second transverse flaps each being connected by a fifth fold line to a third transverse flap interacting with the inner face of the second walls facing them.

3. The tray as claimed in claim 1, wherein the basis weight of the cardboard of the bottom and of the two first side walls is different from that of the two second side walls.

4. The tray as claimed in claim 1, wherein the corrugations of the first walls and of the second walls are perpendicular to the bottom of said tray.

5. The tray as claimed in claim 1, wherein each second wall also comprises at least one second longitudinal flap connected to said second wall by a sixth fold line on the side opposite to the first longitudinal flap.

6. The tray as claimed in claim 5, wherein said second longitudinal flap itself comprises at least one end tongue that is folded down.

7. The tray as claimed in claim 6, wherein each second wall comprises a single longitudinal flap furnished on either side with an end tongue that is folded down and bonded to the outer face of the first flap or of the first side wall facing it, said single longitudinal flap forming a transverse protruding element on two opposite ends of said tray.

8. The tray as claimed in claim 6, wherein each second wall comprises two longitudinal end flaps each furnished with one of said end tongues that is folded down, forming consolidation lugs to the four opposite ends of said tray.

9. The tray as claimed in claim 5, wherein each first transverse flap also comprises at least one side tongue that is folded down and bonded to a one-piece longitudinal flap forming a protruding element.

10. The tray as claimed in claim 5, wherein the side ends of the first longitudinal flaps bonded to the external face of the bottom of the tray are of a shape to match a surface of the second longitudinal flap(s), in order to allow one to fit into the other when two trays are stacked on one another.

11. The tray as claimed in claim 1, wherein each second wall comprises a central fold in an isosceles triangular and two first longitudinal flaps situated on either side of said central fold.

12. The tray as claimed in claim 1, the tray comprises eight sides.

13. The tray as claimed in claim 1, wherein the third fold lines are at an angle relative to the perpendicular to the first fold lines so as to give a frustoconical shape to said tray.

14. The tray as claimed in claim 1, wherein at least one first side wall comprises fifth flaps connected on either side of said first wall by sixth fold lines capable of interacting with the outer face of an adjacent transverse flap.

15. The tray as claimed in claim 1, wherein the second walls are higher than the adjacent first side walls.

16. The tray as claimed in claim 1, wherein it comprises a first side wall that is pierced with holes partially or over the whole of its length or furnished with a longitudinal tear-off strip.

17. A set of blanks to form a tray made of cardboard sheet material, wherein it comprises a first blank formed of a bottom having an external face connected by first fold lines to two first opposite side walls, each first side wall having an inner face, and at least a second blank capable of forming at least one of two second opposite side walls of said tray that are identical and symmetrical relative to a line of separation, each second side wall each comprising at least a first longitudinal flap connected on one side to a corresponding second wall by a second fold line and on the other side by said line of separation to the outer periphery of the other first longitudinal flap of the other second symmetrical side wall facing it, said first longitudinal flaps being arranged to be bonded to the external face of the bottom, the second fold line being offset to allow compensation of a thickness of corrugated board when the tray is formed, the side ends of the first longitudinal flaps bonded to the external face of the bottom of the tray are of a shape to match an upper surface of the tray or second longitudinal flap(s) in order to allow one to fit into the other when two trays are stacked on one another, and each second wall also comprising two sets of transverse flaps, said sets of transverse flaps each comprising at least one transverse flap suitable for being respectively bonded to a corresponding first side wall facing it when the tray is formed and wherein each set of transverse flaps comprises a first transverse flap connected to the corresponding second side wall by a third fold line and is capable of being bonded to the inner face of the adjacent first side wall.

18. The set of blanks as claimed in claim 17, wherein each set of transverse flaps comprises a second transverse flap connected by a fourth fold line to said first transverse flap to form a corner of the tray, said second transverse flaps themselves each being connected by a fifth fold line to a third transverse flap to interact with the inner face of the second walls facing them.

19. The set of blanks as claimed in claim 17, wherein each second wall also comprises at least one second longitudinal flap connected to said second wall by a sixth fold line on the side opposite to the first longitudinal flap.

20. The set of blanks as claimed in claim 17, wherein each second wall comprises a central fold in an isosceles triangular shape and two first longitudinal flaps situated on either side of said central fold.

21. The set of blanks as claimed in claim 17, wherein the third fold lines are at an angle relative to the perpendicular to the first fold lines, so as to give a frustoconical shape to said tray once formed.

22. A device for forming a tray from two blanks of cardboard sheet material or corrugated cardboard, namely a first blank formed of a bottom connected by first fold lines to two first opposite side walls and a second blank capable of forming two second opposite side walls of said tray, that are identical and symmetrical relative to a line of separation, each second side wall comprising at least one first longitudinal flap connected on one side to a corresponding second wall by a second fold line and on the other side by the said line of separation to the outer periphery of the other first longitudinal flap of the second symmetrical side wall facing it, the side ends of the first longitudinal flaps being of a shape to match an upper surface, once formed, of the tray or second longitudinal flap(s), in order to allow one to fit into the other when two trays are stacked on one another, and two sets of transverse flaps each comprising at least one transverse flap, wherein the device comprises two storage magazines for storing respectively the first and second blanks, means for cutting the second blank at the line of separation to form the two second opposite side walls, means for picking up and transferring the first blank from the storage magazine to an assembly station, means for firmly positioning the first blank in abutment in order to give it an exact reference position, means for picking up and transferring laterally by suction cups the second walls in order to place them on the first blank cut-out thus indexed, means for pasting the first longitudinal flaps and the inner face of the second walls and/or of the sets of second flaps during their transfer, means for pressing the first longitudinal flaps on the external face of the bottom of first blank, means for folding the sets of flaps toward the second walls, means for transferring the set of blanks thus constituted to a forming station, and forming means at said forming station for pressing the sets of transverse flaps on the corresponding inner face of the second walls such as the side ends of the first longitudinal flaps are of a shape to match the upper surface of the tray or the second longitudinal flap(s) in order to allow one to fit into the other when two trays are stacked on one another.

23. The device as claimed in claim 22, wherein the forming means comprise a mandrill and means for winding the set of blanks around said mandrill in order to form the tray.

24. The device as claimed in claim 22, wherein each set of transverse flaps comprises a first transverse flap connected to the corresponding second side wall by a third fold line and a second transverse flap connected by a fourth fold line to said first transverse flap, said second transverse flaps each being themselves connected by a fifth fold line to a third transverse flap, the means for folding said sets comprise pins for forming a corner of the tray and pushing means for pressing said third transverse flaps onto the inner face of the second walls facing them.

25. The device as claimed in claim 23, wherein each second wall also comprises at least one second longitudinal flap connected to said second wall by a sixth fold line on the side opposite to the first longitudinal flap, and wherein the device also comprises means for folding said second longitudinal flap to form at least two lugs or two protruding elements on either side of the tray, and in that the mandrill can be retracted between a position of forming the tray and a position of escapement from the lugs or protruding elements.

26. The device as claimed in claim 23, wherein each second wall comprises three central fold lines parallel to the third fold lines and two first longitudinal flaps situated on either side of said central fold, and wherein the device comprises means for folding said three lines to form in the middle of said second walls a central fold in an isosceles triangular shape.

27. A method for forming a tray from two blanks of cardboard sheet material or corrugated cardboard, namely a first blank formed of a bottom connected by first fold lines to two first opposite side walls and a second blank capable of forming two second opposite side walls of said tray, identical and symmetrical relative to a line of separation, each second side wall each comprising at least one first longitudinal flap connected on one side to a corresponding second wall by a second fold line and on the other side by said line of separation to the outer periphery of the other first longitudinal flap of the second symmetrical side wall facing it, the side ends of the first longitudinal flaps bonded to the external face of the bottom of the tray are of a shape to match an upper surface of the tray or second longitudinal flap(s) in order to allow one to fit into the other when two trays are stacked on one another, and two sets of transverse flaps each comprising at least one transverse flap, wherein, after cutting the second blank at the line of separation to form the two second opposite side walls, the first blank is transferred to an assembly station, the first blank is firmly positioned in abutment in order to give it an exact reference position, the second walls are transferred laterally by suction cups while pasting the first longitudinal flaps and the inner face of the second walls and/or the sets of second flaps during their transfers, then they are placed on the first blank cut-out thus indexed, the first longitudinal flaps are pressed onto the external face of the bottom of the first blank, the sets of flaps are folded toward the second walls, and the set of blanks thus constituted is transferred to a forming station to form the tray said forming involving the step of pressing the sets of transverse flaps on the corresponding inner face of the second walls.

28. The method as claimed in claim 27, wherein each set of transverse flaps comprising a first transverse flap connected to the corresponding second side wall by a third fold line and a second transverse flap connected by a fourth fold line to said first transverse flap, said second transverse flaps each being themselves connected by a fifth fold line to a third transverse flap, said sets are folded around pins to form a corner of the tray and said third transverse flaps are pressed onto the inner face of the second walls facing them.

29. The forming method as claimed in claim 27, wherein the tray is formed around a mandrill.

30. The method as claimed in claim 29, wherein each second wall also comprising at least one second longitudinal flap connected to said second wall by a sixth fold line on the side opposite to the first longitudinal flap, said at least one second longitudinal flap is folded to form at least two lugs or two protruding elements on either side of the tray, and the mandrill is retracted between a position for forming the tray and a position of escapement from the lugs or protruding elements.

31. The method as claimed in claim 27, wherein each second wall comprising three lines of central folds parallel to the third fold lines and two first longitudinal flaps situated on either side of said central fold, said three fold lines are folded to form, in the middle of said second walls, a central fold in an isosceles triangular shape.

* * * * *